US010004114B2

(12) United States Patent
Lee et al.

(10) Patent No.: US 10,004,114 B2
(45) **Date of Patent: *Jun. 19, 2018**

(54) INDUCTION HEATING COOKER

(71) Applicant: SAMSUNG ELECTRONICS CO., LTD., Suwon-si, Gyeonggi-do (KR)

(72) Inventors: Sung Ho Lee, Suwon (KR); Jae Man Joo, Suwon (KR); Seok Weon Hong, Yongin (KR); Jong Chull Shon, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 382 days.

This patent is subject to a terminal disclaimer.

(21) Appl. No.: 14/708,692

(22) Filed: May 11, 2015

(65) Prior Publication Data

US 2015/0245418 A1 Aug. 27, 2015

Related U.S. Application Data

(63) Continuation of application No. 13/023,899, filed on Feb. 9, 2011, now Pat. No. 9,060,389.

(30) Foreign Application Priority Data

Feb. 10, 2010 (KR) ..... 10-2010-0012577

(51) Int. Cl.
*H05B 6/04* (2006.01)
*H05B 6/08* (2006.01)
(Continued)

(52) U.S. Cl.
CPC ..... *H05B 6/065* (2013.01); *H05B 6/12* (2013.01); *H05B 2213/03* (2013.01)

(58) Field of Classification Search
CPC ..... H05B 6/04; H05B 6/06; H05B 6/08
(Continued)

(56) References Cited

U.S. PATENT DOCUMENTS 6,018,154 A 1/2000 Izaki et al.
2001/0015352 A1 8/2001 Ohishi et al.
(Continued)

FOREIGN PATENT DOCUMENTS

DE 3610196 A1 10/1987
EP 2034800 A1 3/2009
(Continued)

OTHER PUBLICATIONS

English translation of DE 361096 to Rilly, published Oct. 1, 1987, retrieved via Google Patents on May 21, 2014.
(Continued)

*Primary Examiner* — Michael Laflame, Jr.
(74) *Attorney, Agent, or Firm* — Staas & Halsey LLP

(57) ABSTRACT

An induction heating cooker includes a plurality of heating coils to heat a container, an inverter having a plurality of switching elements to be operated such that a high-frequency voltage is selectively supplied to the plurality of heating coils, and a control unit to control the operations of the plurality of switching elements such that the high-frequency voltage is time-divisionally supplied to a heating coil, on which the container is positioned, among the plurality of heating coils. By this configuration, it is possible to reduce the number of inverters and manufacturing costs. In addition, since the thickness of the cooker is reduced, it is possible to reduce the overall size of the cooker.

15 Claims, 13 Drawing Sheets

(51) Int. Cl.
*H05B 6/12* (2006.01)
*H05B 6/06* (2006.01)

(58) Field of Classification Search
USPC ..... 219/621, 626, 661, 662, 663, 664, 665, 219/671
See application file for complete search history.

(56) References Cited

U.S. PATENT DOCUMENTS

| | | | |
|---|---|---|---|
| 2006/0054617 | A1 | 3/2006 | Ryu et al. |
| 2007/0164017 | A1 | 7/2007 | Gouardo et al. |
| 2008/0237215 | A1 | 10/2008 | Lee et al. |

FOREIGN PATENT DOCUMENTS

| | | | |
|---|---|---|---|
| FR | 2863039 | A1 | 6/2005 |
| JP | 2009-231235 | | 10/2009 |
| KR | 10-0179535 | | 11/1998 |
| KR | 10-1997-053359 | | 5/1999 |
| WO | 97/19298 | | 5/1997 |

OTHER PUBLICATIONS

Decision to Grant dated Dec. 3, 2014 in corresponding Chinese Patent Application No. 201110036924.3.
Office Action dated Jun. 27, 2014 in corresponding Korean Patent Application No. 10-2010-0012577.
Office Action dated Mar. 14, 2014 in corresponding Chinese Patent Application No. 201110036924.3.
Extended European Search Report dated Feb. 6, 2014 in corresponding European Application No. 11152978.0.
Office Action dated Sep. 24, 2012 in corresponding U.S. Appl. No. 13/023,899.
Final Office Action dated May 7, 2013 in corresponding U.S. Appl. No. 13/023,899.
Office Action dated Jul. 18, 2014 in corresponding U.S. Appl. No. 13/023,899.
Notice of Allowance dated Feb. 9, 2015 in corresponding U.S. Appl. No. 13/023,899.
U.S. Appl. No. 13/023,899, filed Feb. 9, 2011, Sung Ho Lee et al., Samsung Electronics Co., Ltd.
European Communication dated Oct. 25, 2017 in European Patent Application No. 11152978.0.

INDUCTION HEATING COOKER

CROSS-REFERENCE TO RELATED APPLICATIONS

This application is a continuation application of U.S. patent application Ser. No. 13/023,899 filed on Feb. 9, 2011 in the U.S. Patent and Trademark Office, the disclosure of which is incorporated herein in its entirety by reference, and claims the benefit of Korean Patent Application No. 10-2010-0012577, filed on Feb. 10, 2010 in the Korean Intellectual Property Office, the disclosure of which is incorporated herein by reference.

BACKGROUND

1. Field

Embodiments of the present invention relate to an induction heating cooker having an inverter to supply a high-frequency voltage to a heating coil to heat a container.

2. Description of the Related Art

In general, an induction heating cooker enables high-frequency current to flow through a heating coil to generate a strong high-frequency magnetic field in the heating coil and generates eddy current in a container magnetically coupled to the heating coil through the high-frequency magnetic field such that the container is heated by Joule's heat to cook food.

In the induction heating cooker, an inverter enables the high-frequency current to flow through the heating coil. The inverter generally drives a switching element including an Insulated Gate Bipolar Transistor (IGBT) to apply a high-frequency voltage to the heating coil, thereby generating the high-frequency magnetic field in the heating coil.

In such an induction heating cooker, the heating coil is fixed to the inside of a main body to provide a heating source. In addition, a cooking plate on which a container is placed is provided on an upper side of the main body. On this cooking plate, a mark is formed at a position corresponding to the heating coil to enable a user to accurately position a container.

However, such a method is inconvenient because the user must accurately position the container at a specific position on the cooking plate.

Accordingly, a recent induction heating cooker has a function for sensing a position where a container is positioned and heating the container, without the need to position the container at a specific position. In this case, in the induction heating cooker, a large number of heating coils is arranged throughout the heating cooker.

In general, since the induction heating cooker drives one heating coil using one inverter, if the number of heating coils is increased, the number of inverters is also increased.

However, if the number of inverters is increased, manufacturing costs are increased. In addition, since the thickness of the cooker is increased due to space limitations, it is difficult to reduce the overall size of the cooker.

SUMMARY

Therefore, it is an aspect of the present invention to provide an induction heating cooker to time-divisionally drive a plurality of independent heating coils using one inverter in order to reduce the number of inverters to drive the heating coils.

Additional aspects of the invention will be set forth in part in the description which follows and, in part, will be obvious from the description, or may be learned by practice of the invention.

In accordance with one aspect of the present invention, there is provided an induction heating cooker including: a plurality of heating coils to heat a container; an inverter having a plurality of switching elements to be operated such that a high-frequency voltage is selectively supplied to the plurality of heating coils; and a control unit to control the operations of the plurality of switching elements such that the high-frequency voltage is time-divisionally supplied to a heating coil, on which the container is positioned, among the plurality of heating coils.

The induction heating cooker may further include a sensing unit to sense current flowing through the plurality of heating coils, and the control unit may detect the heating coil, on which the container is positioned, among the plurality of heating coils according to the current value sensed by the sensing unit.

The induction heating cooker may further include a display unit to display positional information of the heating coil, on which the container is positioned.

The induction heating cooker may further include an input unit to receive power levels of the heating coil, on which the container is positioned.

The inverter may include main switching elements switched to supply the high-frequency voltage to any one of the plurality of heating coils, and, if the container is positioned on a plurality of heating coils, the control unit may switch the plurality of switching elements on during the same time and vary the duty ratios of pulse width modulation signals supplied to the main switching elements in a period when the plurality of switching elements is continuously switched on to control the power levels of the time-divisionally controlled heating coils.

The control unit may supply pulse width modulation signals having duty ratios set to values corresponding to the power levels of the time-divisionally controlled heating coils to the main switching elements.

The inverter may include main switching elements switched to supply the high-frequency voltage to any one of the plurality of heating coils, and, if the container is positioned on a plurality of heating coils, the control unit may supply pulse width modulation signals having the same duty ratio to the main switching elements and vary the on times of the switching elements corresponding to the time-divisionally controlled heating coils to control the power levels of the time-divisionally controlled heating coils.

The duty ratios of the pulse width modulation signals supplied to the main switching elements may be set to a value corresponding to a maximum power level among the power levels of the heating coils, on which the container is positioned.

The control unit may vary the on times of the switching elements corresponding to the time-divisionally controlled heating coils according to the maximum power level.

The duty ratios of the pulse width modulation signals supplied to the main switching elements may be set to a value corresponding to a highest power level that the induction heating cooker is capable of outputting.

The control unit may vary the on times of the switching elements corresponding to the time-divisionally controlled heating coils according to the highest power level.

In accordance with another aspect of the present invention, there is provided an induction heating cooker including: a plurality of heating coils to heat a container; an inverter having a plurality of auxiliary switching elements operated to selectively supply a high-frequency voltage to the plurality of heating coils and main switching elements switched to supply the high-frequency voltage to any one of the plurality of heating coils; and a control unit to control the operations of the plurality of switching elements such that the high-frequency voltage is time-divisionally supplied to a plurality of heating coils, on which the container is positioned, among the plurality of heating coils and to control the operations of the auxiliary switching units and the main switching units to control power levels of the time-divisionally controlled heating coils.

The control unit may switch the plurality of switching elements corresponding to the heating coils, on which the container is positioned, on at the same time and vary the duty ratios of pulse width modulation signals supplied to the main switching elements in a period when the plurality of switching elements is continuously switched on to control the power levels of the time-divisionally controlled heating coils.

The control unit may supply pulse width modulation signals having the same duty ratio to the main switching elements and vary the on times of the switching elements corresponding to the time-divisionally controlled heating coils to control the power levels of the time-divisionally controlled heating coils.

The duty ratios of the pulse width modulation signals supplied to the main switching elements may be set to a value corresponding to a maximum power level among the power levels of the plurality of heating coils, on which the container is positioned, or a highest power level that the induction heating cooker is capable of outputting.

According to the embodiments of the present invention, since a plurality of independent heating coils is time-divisionally driven using one inverter, it is possible to reduce the number of inverters and manufacturing costs. In addition, since the thickness of the cooker is reduced, it is possible to reduce the overall size of the cooker.

BRIEF DESCRIPTION OF THE DRAWINGS

These and/or other aspects of the invention will become apparent and more readily appreciated from the following description of the embodiments, taken in conjunction with the accompanying drawings of which:

FIG. 6 is a diagram showing a current path when the first main switching element Q1 shown in FIG. 4 is switched off and the second main switching element Q2 is switched on;

DETAILED DESCRIPTION

Figure 1:
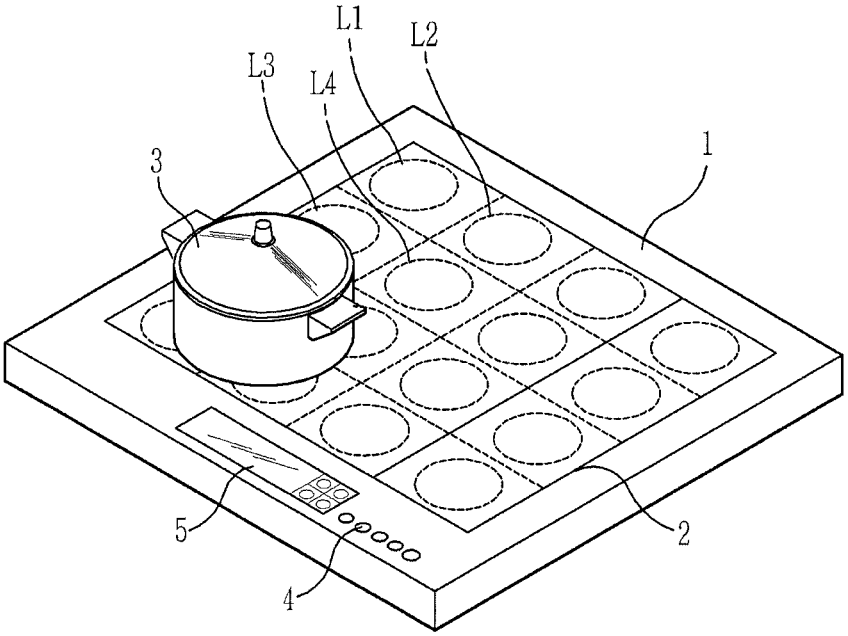
FIG. 1 is a diagram showing the configuration of an induction heating cooker according to an embodiment of the present invention.

Reference will now be made in detail to the embodiments of the present invention, examples of which are illustrated in the accompanying drawings, wherein like reference numerals refer to like elements throughout.

FIG. 1 is a diagram showing the configuration of an induction heating cooker according to an embodiment of the present invention.

As shown in FIG. 1, the induction heating cooker according to the embodiment of the present invention includes a main body 1.

On an upper side of the main body 1, a cooking plate 2 on which a container 3 will be placed is provided.

In the main body 1, a plurality of heating coil groups each including heating coils L1 to L4 to provide a heating source to the cooking plate 2 is provided below the cooking plate 2.

Each heating coil group includes, for example, four heating coils L1, L2, L3 and L4, which are arranged at the same interval in a 2×2 matrix. It is understood that the interval will vary.

FIG. 1 shows four heating coil groups each including four heating coils L1 to L4.

One heating coil group including the heating coils L1 to L4 is operated by one inverter.

In the embodiment of the present invention, a high-frequency voltage is time-divisionally supplied to heating coils, on which a container is positioned, of the heating coil group including the heating coils L1 to L4 to heat the container positioned on the heating coils.

Accordingly, by the configuration in which several heating coils are operated using one inverter, inverters corresponding in number to the number of heating coils are not necessary. Therefore, it is possible to reduce the number of inverters.

In FIG. 1, 16 heating coils may be controlled using four inverters.

In addition, several manipulation buttons 4 to input respective commands to a control device in order to operate each heating coil group including the heating coils L1 to L4 and a display window 5 to display information are provided on one side of the main body 1.

Accordingly, a user places a container 3 on the cooking plate 2, checks the position of the heating coil L1, L2, L3 or L4, on which the container is placed, of the heating coil group including the heating coils L1 to L4 used to heat the container through the display window 5, and presses the manipulation buttons 4 to input a power level of the heating coil L1, L2, L3 or L4, on which the container is placed, such that a high-frequency voltage is supplied to the heating coil L1, L2, L3 or L4, on which the container is placed, to heat the container 3.

Figure 2:
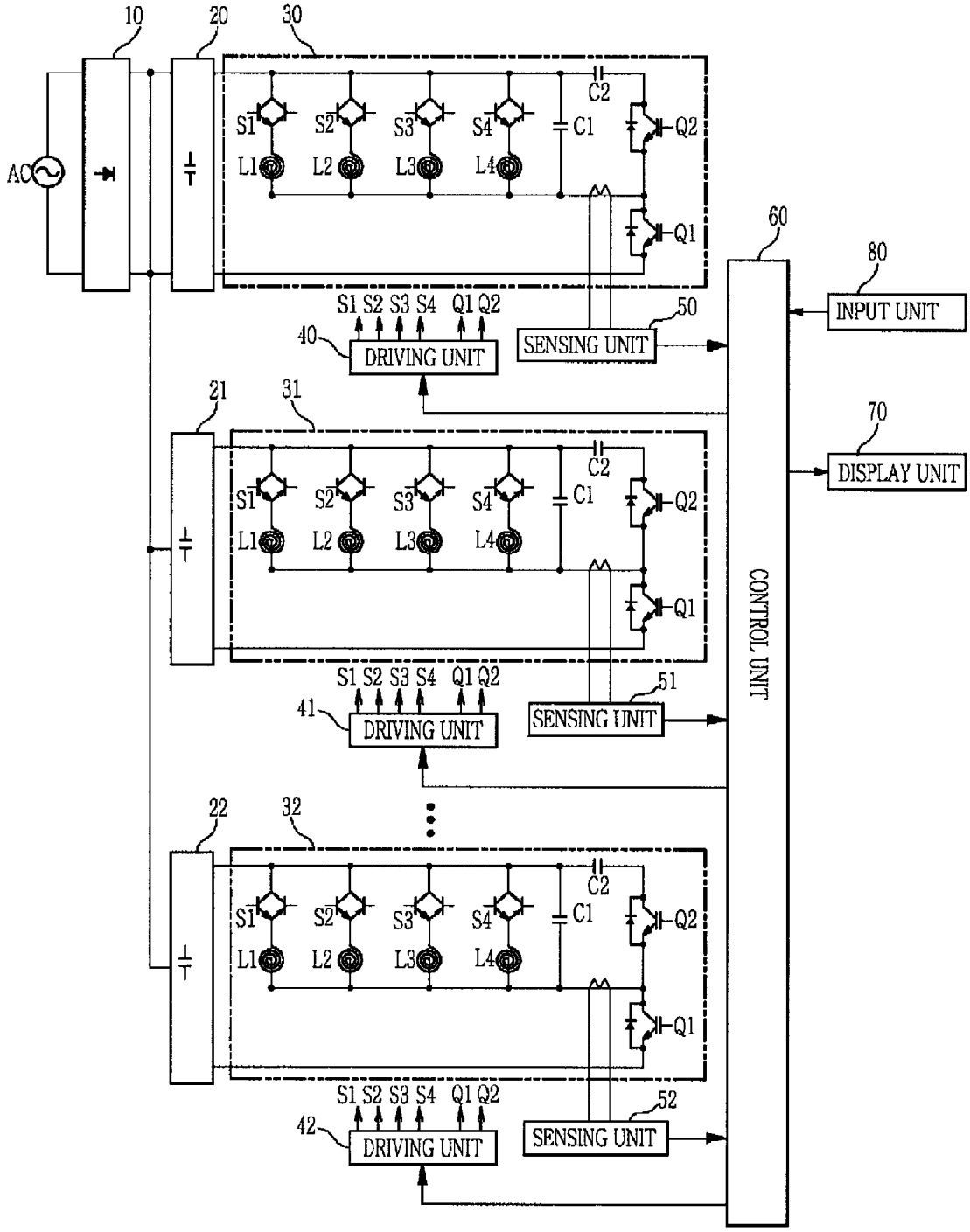
FIG. 2 is a block diagram of the induction heating cooker according to the embodiment of the present invention.

FIG. 2 is a block diagram of the induction heating cooker according to the embodiment of the present invention, in which a high-frequency voltage is time-divisionally supplied to the heating coil group including four heating coils L1 to L4 using one inverter.

As shown in FIG. 2, the induction heating cooker according to the embodiment of the present invention includes a rectifier 10, a smoothing unit 20 to 22, inverters 30 to 32, driving units 40 to 42, sensing units 50 to 52, a control unit 60, a display unit 70, and an input unit 80.

The heating coil groups each including the heating coils L1 to L4 are independently driven by inverters 30, 31 and 32, respectively. That is, the first heating coil group including the heating coils L1 to L4 is driven by the first inverter 30, the second heating coil group including the heating coils L1 to L4 is driven by the second inverter 31, and the third heating coil group including the heating coils L1 to L4 is driven by the third inverter 32.

The rectifier 10 rectifies an input AC voltage and outputs a rectified eddy voltage.

The smoothing unit 20 smoothes the eddy voltage received from the rectifier 20 and outputs a smoothed constant DC voltage.

Each of the inverters 30 to 32 includes main switching elements Q1 and Q2, auxiliary switching elements S1 to S4, and capacitors C1 and C2.

The main switching elements Q1 and Q2 alternately switch the smoothed voltage output from the smoothing unit 20 to 22 according to switching control signals of the driving units 40 to 42 to generate and supply a high-frequency voltage to each heating coil L1, L2, L3 or L4.

The auxiliary switching elements S1 to S4 are selectively switched on or off such that the high-frequency voltage is selectively supplied to each heating coil L1, L2, L3 or L4 according to the driving signals of the driving units 40 to 42. Each of the auxiliary switching elements S1 to S4 is configured by connecting two transistors and performs bidirectional conduction when turned on.

The first capacitor C1 and the second capacitor C2 enable current to flow through each heating coil L1, L2, L3 or L4 while the first main switching element Q1 is switched off and the second main switching element Q2 is switched on. The second capacitor C2 is provided in a current path between the first capacitor C1 and each heating coil L1, L2, L3 or L4, and enables resonance current to flow through each heating coil L1, L2, L3 or L4 by LC series resonance when the second main switching element Q2 is switched on.

The heating coils L1, L2, L3 and L4 are connected in parallel, one side of the heating coil L1, L2, L3 or L4 is connected to the auxiliary switching element S1, S2, S3 or S4, and the other side thereof is connected to a line for connecting the two main switching elements Q1 and Q2.

Accordingly, the main switching elements Q1 and Q2 are alternately switched according to pulse width modulation signals to periodically vary a direction of current flowing through the heating coil connected to a switched-off auxiliary switching element S1, S2, S3 or S4 among the auxiliary switching elements S1 to S4.

That is, if the main switching element Q1 is switched on and the second main switching element Q2 is switched off, high-frequency current flows according to the high-frequency voltage supplied to the heating coil connected to the switched-off auxiliary switching element S1, S2, S3 or S4 among the heating coils L1, L2, L3 and L4. If the main switching element Q1 is switched off and the second main switching element Q2 is switched on, high-frequency current due to LC series resonance flows through the heating coil connected to the switched-off auxiliary switching element S1, S2, S3 or S4 in an opposite direction of the previous high-frequency current direction.

Then, a strong high-frequency alternating magnetic field is generated in the heating coil and eddy current is generated in the container 3 magnetically coupled to the heating coil such that the container 3 is heated by Joule's heat generated by the eddy current.

The driving units 40 to 42 output the pulse width modulation signals to the main switching elements Q1 and Q2 of the inverters 30 to 32 according to a control signal of the control unit 60 to alternately switch the main switching elements Q1 and Q2, and output driving signals to the auxiliary switching elements S1 to S4 to switch the auxiliary switching elements S1 to S4 on or off.

Each of the sensing units 50 to 52 is connected to a line between each heating coil group including the heating coils L1 to L4 and the main switching element Q1 to sense the position of the heating coil, on which the container is positioned, of the heating coil group including the heating coils L1 to L4 and to sense current flowing through each heating coil L1, L2, L3 or L4. The sensing unit 50 includes a Current Transformer (CT) sensor.

The display unit 70 displays a variety of information about the induction heating cooker. In particular, the display unit 70 displays positional information of the heating coil, on which the container is positioned.

The input unit 80 receives various commands for the induction heating cooker. In particular, the input unit 80 receives a power level of a heating coil selected by the user among the heating coils, on which the container is positioned, displayed on the display unit 70.

The control unit 60 performs overall control of the induction heating cooker.

When a cooking command is input through the input unit 80, the control unit 60 controls the operation of the inverter 30 through the driving unit 40 to enable current to sequentially flow through each heating coil L1, L2, L3 or L4 of the heating coil group, in order to sense whether or not the container is positioned on each heating coil L1, L2, L3 or L4 of each heating coil group.

The control unit 60 determines whether the container is positioned on each heating coil L1, L2, L3 or L4 of each heating coil group, according to the current value sensed using each of the sensing units 50 to 52. That is, each auxiliary switching element S1, S2, S3 or S4 is sequentially switched on one by one while alternately switching the main switching elements Q1 and Q2 through each of the driving units 40 to 42 to determine whether or not the container is positioned on each heating coil according to the current value sensed using each of the sensing units 50 to 52.

In addition, the control unit 60 displays the positional information of the heating coils, on which the container is positioned, of each heating coil group on the display unit 70. Then, the user inputs the power levels of the heating coils, on which the container is positioned, of each heating coil group through the input unit 80.

In addition, the control unit 60 switches the main switching elements Q1 and Q2 of the inverter 30 to 32 through the driving units 40 to 42 such that the high-frequency voltage is time-divisionally supplied to the heating coils, on which the container is positioned, and switches the auxiliary switching elements S1 to S4 on or off.

That is, the control unit 60 switches only the first auxiliary switching element corresponding to the first heating coil among the heating coils, on which the container is positioned, on during a time-divisional control time to open a current path to enable current to flow through only the first heating coil, and alternately switches the main switching elements Q1 and Q2 to supply the high-frequency voltage to the first heating coil such that only the container positioned on the first heating coil is heated.

Thereafter, if a predetermined time elapses after the first auxiliary switching element is switched on, the control unit 60 switches the first auxiliary switching element off and switches only the second auxiliary switching element corresponding to the second heating coil, on which the container is positioned, on during a time-divisional control time to open a current path to enable current to flow through the second heating coil, and alternately switches the main switching elements Q1 and Q2 to supply the high-frequency voltage to the second heating coil such that only the container positioned on the second heating coil is heated.

Using this method, the high-frequency voltage is sequentially supplied to the remaining heating coils, on which the container is positioned, to sequentially heat the container positioned on the heating coils.

The control unit 60 may control the power levels of the time-divisionally controlled heating coils, on which the container is positioned, using two methods as below described.

In a first method, a time-divisional control time when only the auxiliary switching element corresponding to the time-divisionally controlled heating coil is switched on is fixed and the duty ratios of the pulse width modulation signals supplied to the main switching elements Q1 and Q2 are varied according to a value corresponding to the power level of the heating coil during the time-divisional control time. At this time, the time-divisional control times of the auxiliary switching elements corresponding to the heating coils, on which the container is positioned, are equally set.

At this time, the duty ratios of the pulse width modulation signals supplied to the main switching elements Q1 and Q2 are increased as the power level of the heating coil is increased, and the duty ratios of the pulse width modulation signals supplied to the main switching elements Q1 and Q2 are decreased as the power level of the heating coil is decreased. The high duty ratio indicates that a high-level period is relatively longer than a low-level period. The low duty ratio indicates that a low-level period is relatively longer than a high-level period.

In a second method, the duty ratios supplied to the main switching elements Q1 and Q2 are fixed to a value corresponding to a maximum power level among the power levels of the heating coils, on which the container is positioned, and the on time of the auxiliary switching element corresponding to the time-divisionally controlled heating coil is varied according to a value corresponding to the power level of the time-divisionally controlled heating coil in consideration of the maximum power level.

Hereinafter, the operation of the control unit 60 will be described in detail.

Figure 3:
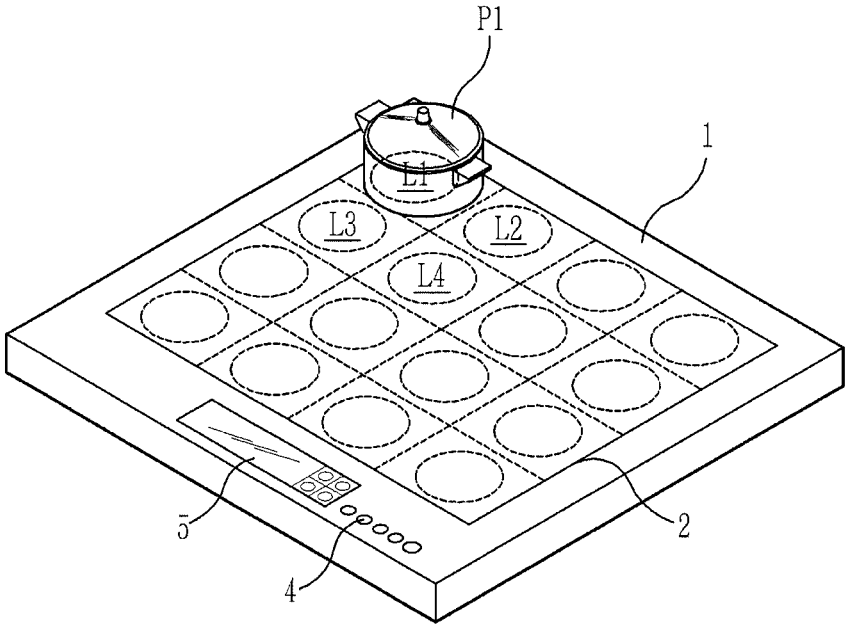
FIG. 3 is a diagram showing the case where a container is positioned on one heating coil L1 among a first heating coil group including heating coils L1 to L4 in the induction heating cooker according to the embodiment of the present invention.
Figure 4:
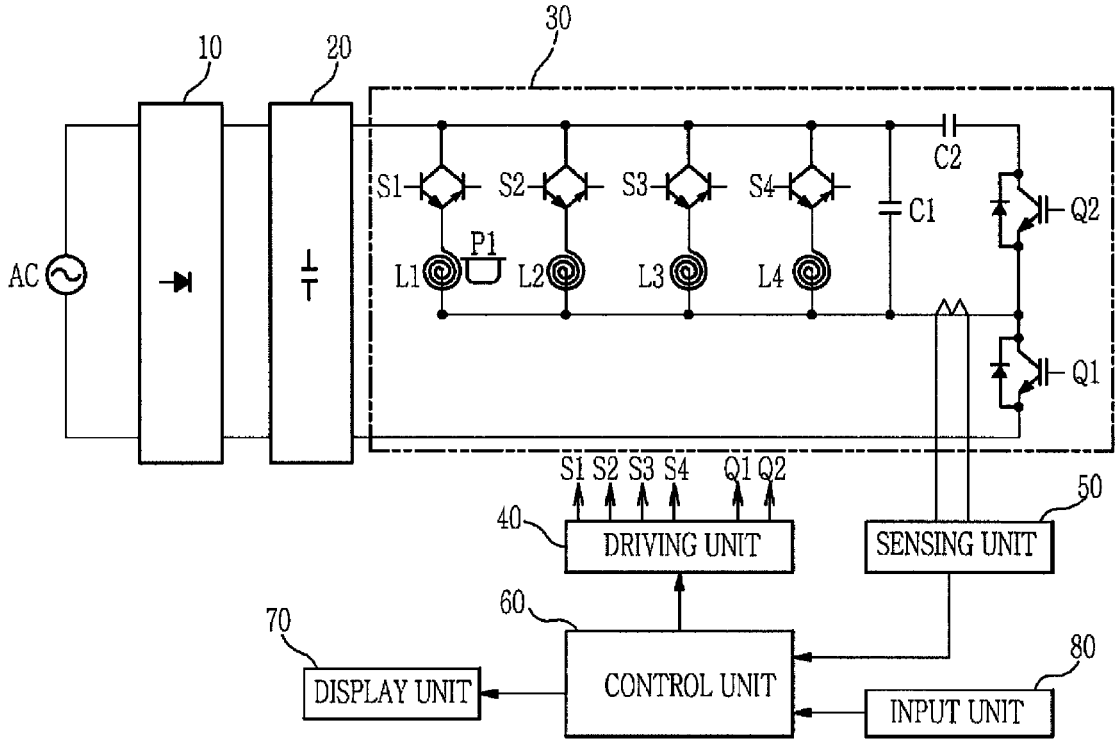
FIG. 4 is a diagram showing an inverter circuit to drive the first heating coil group including the heating coils L1 to L4 and a position where a container is positioned, in the induction heating cooker shown in FIG. 3.

FIG. 3 is a diagram showing the case where a container is positioned on one heating coil L1 of a first heating coil group including heating coils L1 to L4 in the induction heating cooker according to the embodiment of the present invention, and FIG. 4 is a diagram showing an inverter circuit to drive the first heating coil group including the heating coils L1 to L4 and a position where the container is positioned, in the induction heating cooker shown in FIG. 3.

As shown in FIG. 3, the first heating coil group including the four heating coils L1 to L4 is provided on the right upper side of the cooking plate 2 of the induction heating cooker according to the embodiment of the present invention.

The container P1 is positioned on the first heating coil L1 of the first heating coil group including the heating coils L1 to L4 such that the bottom thereof covers only the first heating coil L1. In this case, the high-frequency voltage is time-divisionally supplied to only the first heating coil L1 of the first heating coil group including the heating coils L1 to L4.

As shown in FIG. 4, when the user lays the container P1 on the cooking plate 2, the control unit 60 switches each of the four auxiliary switching elements S1, S2, S3 and S4 of the inverter 30 through the driving unit 40 one by one to sense on which of the four heating coils the container is positioned. In addition, the control unit 60 supplies a pulse width modulation signal having a duty ratio lower than a normal duty ratio to heat the heating coils to the main switching elements Q1 and Q2 while the auxiliary switching element is turned on through the driving unit 40 to alternately switch the main switching elements Q1 and Q2.

Then, minute high-frequency current sequentially flows through each heating coil L1, L2, L3 or L4. In this state, the control unit 60 senses the value of the current flowing through the heating coil through the sensing unit 50, determines that the container is positioned on the heating coil if the sensed current value is a predetermined value, and, otherwise, determines that the container is not positioned on the heating coil. At this time, if the container is positioned on the heating coil, high-frequency magnetic flux generated in the heating coil induces eddy current in the container, and thus relatively large current flows through the heating coil. However, if the container is not positioned on the heating coil, high-frequency magnetic flux generated in the heating coil is not induced in the container and thus little current flows through the heating coil. Accordingly, the control unit 60 checks the value of the current flowing through the heating coil through the sensing unit 50 to determine whether the container is positioned on the heating coil correctly.

Meanwhile, the control unit 60 determines determine that the container P1 is positioned on only the first heating coil L1 by determining whether the container is positioned on the heating coil using the above-described method.

Thereafter, the control unit 60 displays the position information of the first heating coil L1, on which the container P1 is positioned, on the display unit 70. Then, the user selects the first heating coil L1 displayed on the display unit 70 and inputs a desired power level through the input unit 80.

When the user inputs the power level of the heating coil L1, on which the container P1 is positioned, the control unit 60 controls the operations of the main switching elements Q1 and Q2 and the auxiliary switching elements S1 to S4 through the driving unit 40 such that the high-frequency voltage is time-divisionally supplied to the heating coil L1.

That is, the control unit 60 switches only the first auxiliary switching element S1 connected to the first heating coil L1 on to open a current path to enable current to flow only through the first heating coil L1, and alternately switches the main switching elements Q1 and Q2 to supply the high-frequency voltage to the first heating coil L1 such that high-frequency current flows through the first heating coil L1. When the high-frequency current flows, a high-frequency magnetic field is generated in the first heating coil L1 and eddy current is generated in the container P1 positioned on the first heating coil L1 such that the container P1 is heated by Joule's heat generated by the eddy current.

Figure 5:
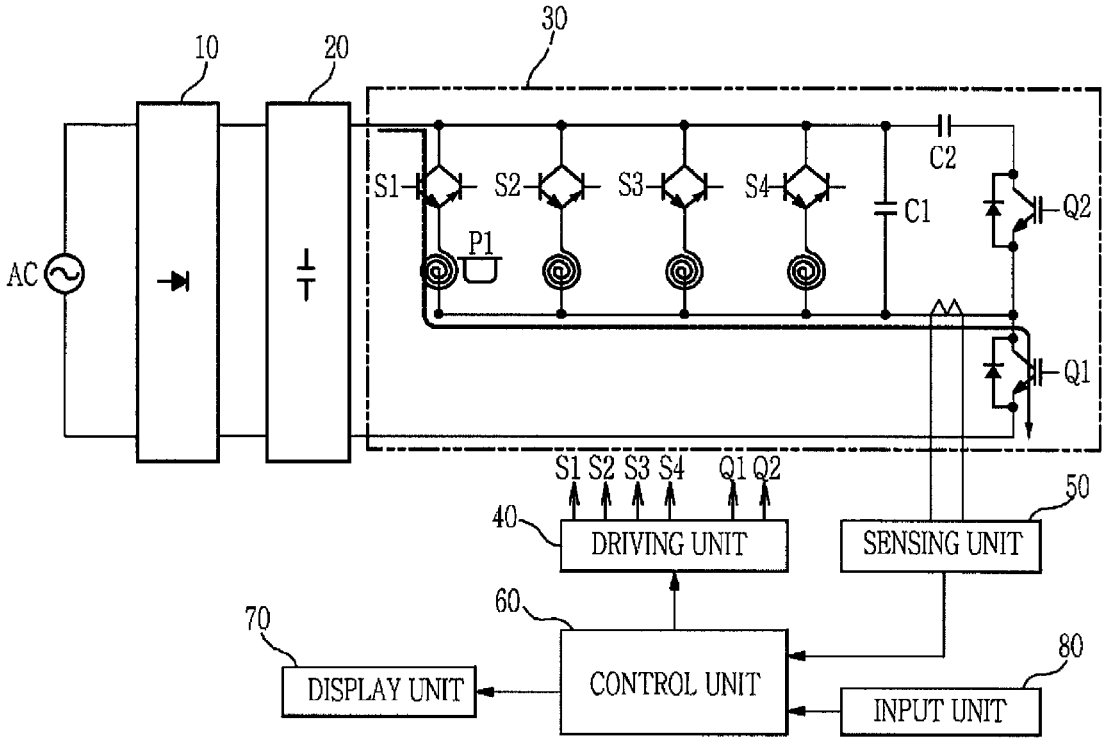
FIG. 5 is a diagram showing a current path when a first main switching element Q1 shown in FIG. 4 is switched on and a second main switching element Q2 is switched off.
Figure 6:
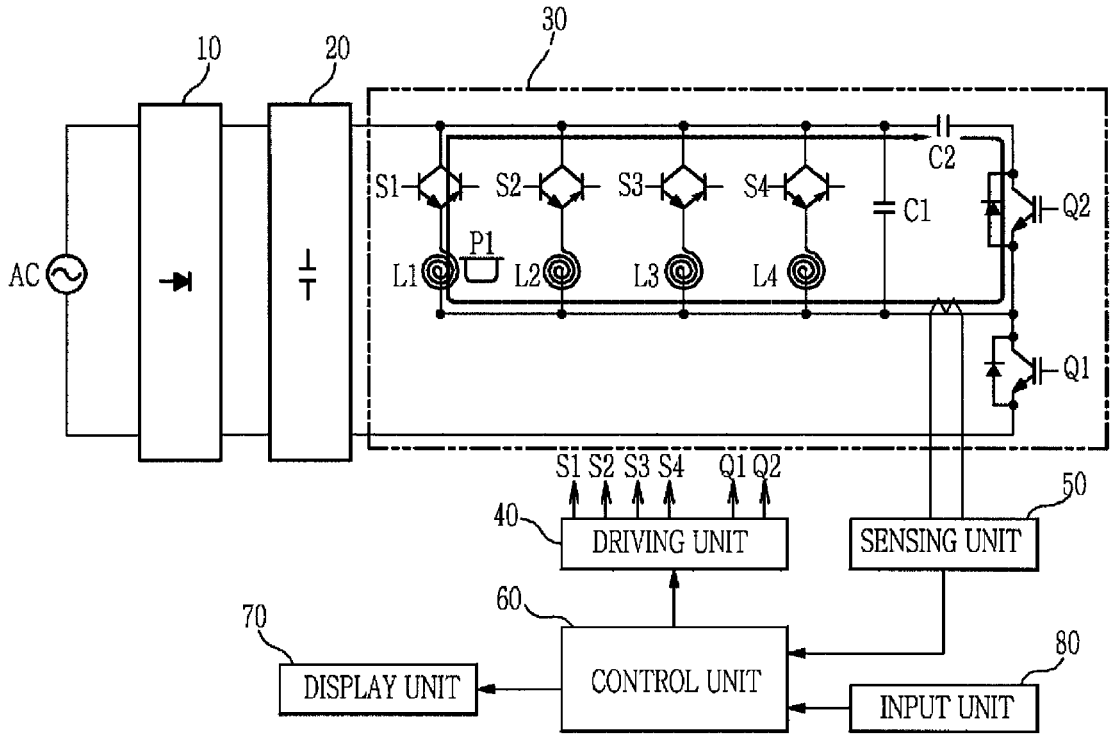

FIG. 5 is a diagram showing a current path when the first main switching element Q1 shown in FIG. 4 is switched on and the second main switching element Q2 is switched off, and FIG. 6 is a diagram showing a current path when the first main switching element Q1 shown in FIG. 4 is switched off and the second main switching element Q2 is switched on.

As shown in FIG. 5, when the control unit 60 switches the first main switching element Q1 on and switches the second main switching element Q2 off through the driving unit 40, the first auxiliary switching element S1, the first heating coil L1 and the first main switching element Q1 form the current path such that current flows through the first heating coil L1 in the direction of the arrow shown in FIG. 5.

As shown in FIG. 6, when the first main switching element Q1 is switched off and the second main switching element Q2 is switched on, the capacitors C1 and C2, the second main switching element Q2, the first heating coil L1 and the first auxiliary switching element S1 form the current path such that current flows through the first heating coil L1 in the direction denoted by the arrow shown in FIG. 6, that is, in a direction opposite the previous current direction.

Since an alternating magnetic field is generated in the first heating coil L1 as current flows through the first heating coil L1 in opposite directions, eddy current is generated in the container P1 positioned on the first heating coil L1 by electromagnetic induction due to the alternating magnetic field and the container P1 is heated by Joule's heat generated by the eddy current. When the container P1 is heated, food in the container is cooked.

At this time, the control unit 60 controls the power level of the first heating coil L1 to reach the power level input through the input unit 80 using any one of the two control methods described above.

Figure 7:
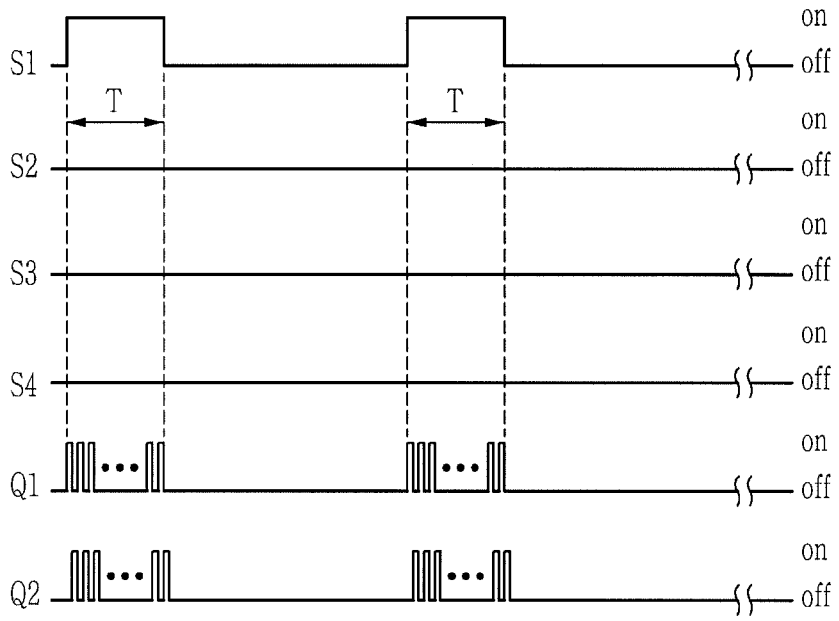
FIG. 7 is a timing chart of the switching elements shown in FIG. 4.

As shown in FIG. 7, the control unit 60 periodically switches the first auxiliary switching element S1 on during a predetermined time T1 (for example. 0.1 sec to 3 sec) through the driving unit 40, sets the duty ratios of the pulse width modulation signals supplied to the main switching elements Q1 and Q2 to the value corresponding to the power level of the first heating coil L1, and supplies the pulse width modulation signals having the set duty ratios to the main switching elements Q1 and Q2 while the first auxiliary switching element S1 is switched on to alternately switch the main switching elements Q1 and Q2.

At this time, the pulse width modulation signals supplied to the first main switching element Q1 and the second main switching element Q2 have the same duty ratio and have a constant delay time such that the main switching elements are alternately switched.

For example, if the power level of the first heating coil L1 is 3200 W, the duty ratios of the pulse width modulation signals supplied to the main switching elements Q1 and Q2 are set to the value corresponding to 3200 W such that the power level of the first heating coil L1 becomes 3200 W during the predetermined on time T1 of the first auxiliary switching element S1.

If the power level of the first heating coil L1 is 2200 W, the duty ratios of the pulse width modulation signals supplied to the main switching elements Q1 and Q2 are set to the value corresponding to 2200 W such that the power level of the first heating coil L1 becomes 2200 W during the predetermined on time T1 of the first auxiliary switching element S1. At this time, the duty ratio of the pulse width modulation signal corresponding to 2200 W is lower than the duty ratio of the pulse width modulation signal corresponding to 3200 W.

For reference, since the container P1 or another container is not positioned on the other heating coils L2, L3 and L4 and the container P1 is positioned only on the first heating coil L1, the high-frequency voltage supplied to the first heating coil L1 may be continuously operated without being time-divisionally controlled. In this case, the high-frequency voltage is set to be lower than the high-frequency voltage when the duty ratios of the pulse width modulation signals supplied to the main switching elements Q1 and Q2 are time-divisionally controlled, in consideration of the on time of the first auxiliary switching element S1 connected to the first heating coil L1.

That is, in the case where the first heating coil L1 is time-divisionally controlled, since the first auxiliary switching element S1 concentratively supplies the high-frequency voltage during the periodic on time T, the duty ratios of the pulse width modulation signals are kept relatively high. In contrast, in the case where the first heating coil L1 is not time-divisionally controlled, since the first auxiliary switching element S1 is continuously switched on, the duty ratios of the pulse width modulation signals are kept relatively low.

Figure 8:
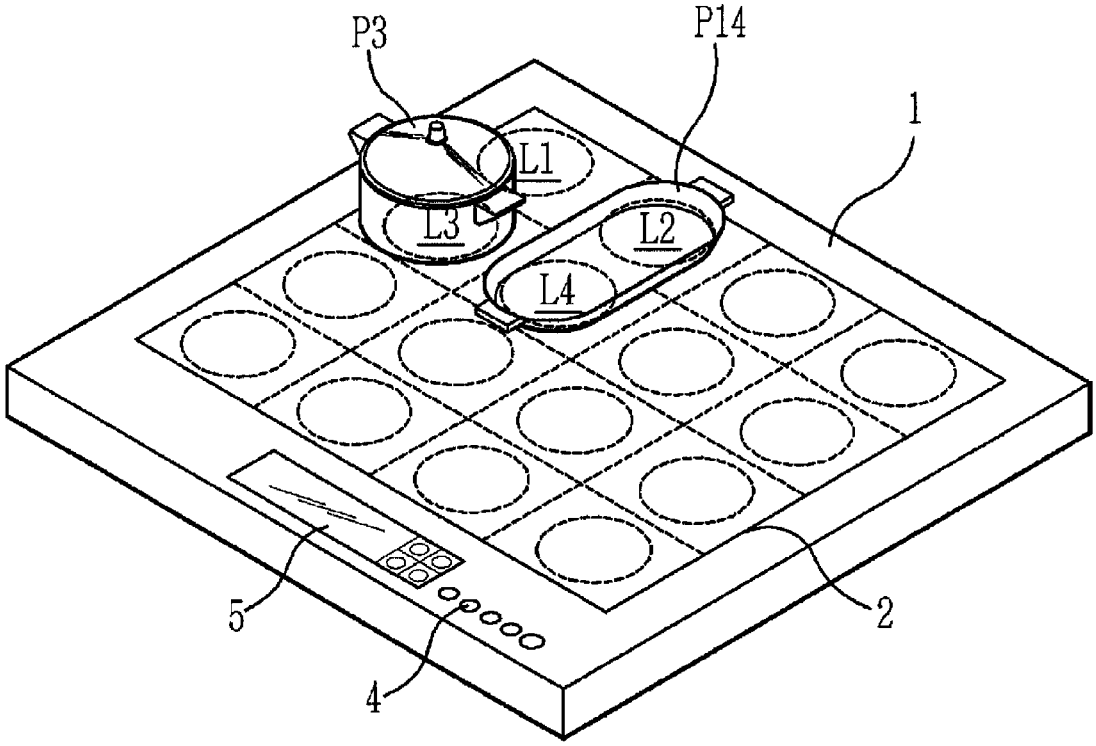
FIG. 8 is a diagram showing the case where two containers are positioned on only three heating coils L2, L3 and L4 among the first heating coil group including the heating coils L1 to L4, in the induction heating cooker according to the embodiment of the present invention.
Figure 9:
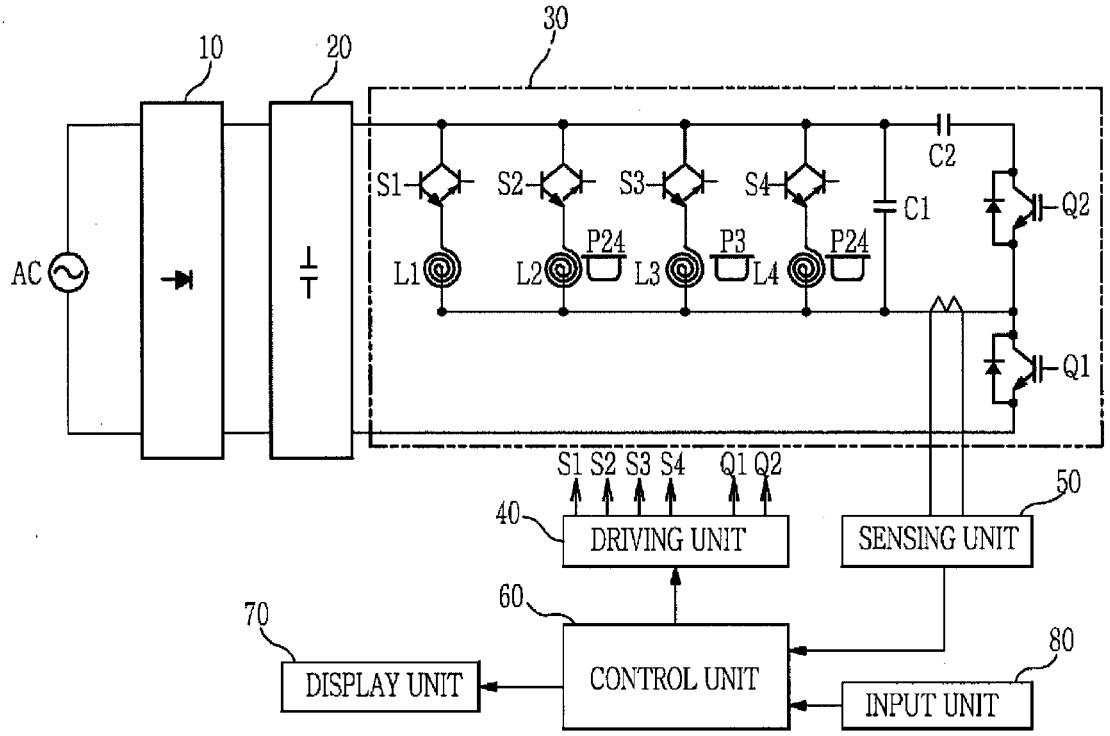
FIG. 9 is a diagram showing the inverter circuit to drive the first heating coil group including the heating coils L1 to L4 and a position where containers are positioned, in the induction heating cooker shown in FIG. 8.

FIG. 8 is a diagram showing the case where two containers P14 and P3 having different bottom areas are positioned on only three heating coils L2, L3 and L4 of the first heating coil group including the heating coils L1 to L4 in the induction heating cooker according to the embodiment of the present invention. FIG. 9 is a diagram showing the inverter circuit to drive the first heating coil group including the heating coils L1 to L4 and a position where the containers are positioned, in the induction heating cooker shown in FIG. 8.

As shown in FIG. 8, in the induction heating cooker according to the embodiment of the present invention, the first heating coil group including the four heating coils is provided on the right upper side of the cooking plate 2.

In the first heating coil group including the heating coils L1 to L4, the container P24 is positioned on the second heating coil L2 and the fourth heating coil L4 such that the bottom thereof covers the second heating coil L2 and the fourth heating coil L4 and the container P3 is positioned on the third heating coil L3 such that the bottom thereof covers only the third heating coil L3. In this case, the high-frequency voltage needs to be time-divisionally supplied to the second heating coil L2, the third heating coil L3 and the fourth heating coil L4 of the first heating coil group including the heating coils L1 to L4.

As shown in FIG. 8, when the user places the two containers P24 and P3 on the cooking plate 2, the control unit 60 switches each of the four auxiliary switching elements S1, S2, S3 and S4 of the inverter 30 on one by one through the driving unit 40 in order to sense on which of the four heating coils the container is positioned. The control unit 60 supplies the pulse width modulation signals having the duty ratios lower than the normal duty ratio to heat the heating coils to the main switching elements Q1 and Q2 while the auxiliary switching elements are switched on through the driving unit 40 to alternately switch the main switching elements Q1 and Q2.

Then, minute high-frequency current sequentially flows through each heating coil L1, L2, L3 or L4. In this state, the control unit 60 senses the value of the current flowing through the heating coil through the sensing unit 50, determines that the container is positioned on the heating coil if the sensed current value is a predetermined value, and, otherwise, determines that the container is not positioned on the heating coil. At this time, if the container is positioned on the heating coil, high-frequency magnetic flux generated in the heating coil induces eddy current in the container, and thus relatively large current flows through the heating coil. However, if the container is not positioned on the heating coil, high-frequency magnetic flux generated in the heating coil is not induced in the container and thus little current flows through the heating coil. Accordingly, the control unit 60 checks the value of the current flowing through the heating coil through the sensing unit 50 to determine whether the container is positioned on the heating coil.

Meanwhile, the control unit 60 determines that the container P24 is positioned on the second heating coil L2 and the fourth heating coil L4 and the container P3 is positioned on the third heating coil L3, by determining whether or not the container is positioned on the heating coil using the above-described method. At this time, the control unit 60 may determine the arrangement of the containers positioned on the second heating coil L2, the third heating coil L3 and the fourth heating coil L4. However, it is sufficient to determine only whether or not the container is positioned on the heating coil.

Thereafter, the control unit 60 displays the positional information of the second heating coil L2, the third heating coil L3 and the fourth heating coil L4, on which the containers P24 and P3 are positioned, on the display unit 70. Then, the user selects the second heating coil L2, the third heating coil L3 and the fourth heating coil L4 displayed on the display unit 70 and inputs a desired power level of each heating coil through the input unit 80.

Figure 10:
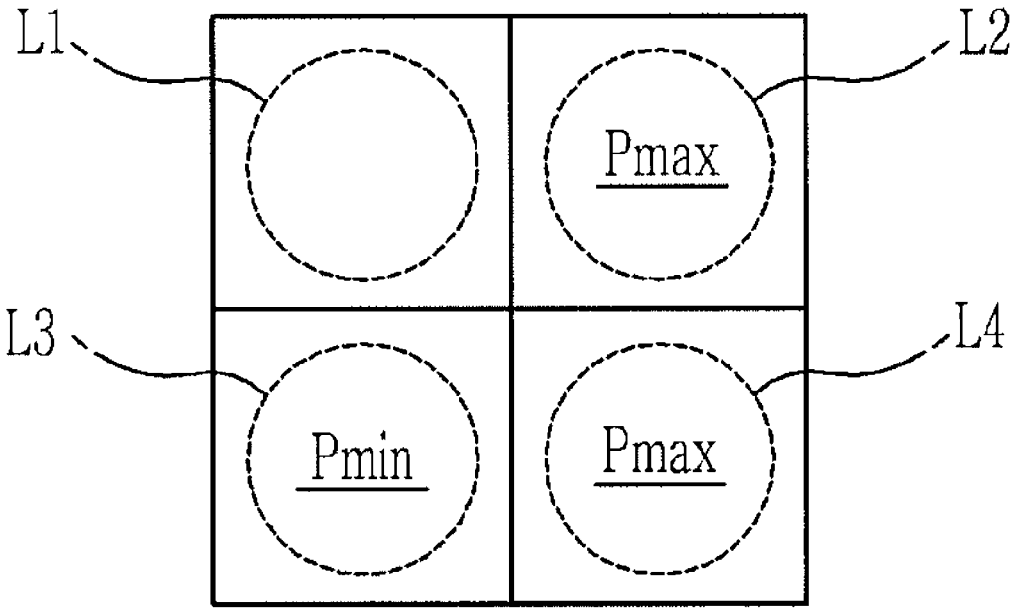
FIG. 10 is a diagram showing an example of power levels of three heating coils in the induction heating cooker shown in FIG. 8.

FIG. 10 is a diagram showing an example of the power levels of three heating coils in the induction heating cooker shown in FIG. 8.

As shown in FIG. 10, the power levels of the second heating coil L2 and the fourth heating coil L4 may be set to a maximum power level Pmax and the power level of the third heating coil L3 may be set to a minimum power level Pmin. In some cases, the power levels of the three heating coils L2, L3 and L4 may be set to different power levels.

When the user inputs the power levels of the heating coils L2, L3 and L4, on which the containers P24 and P3 are positioned, the control unit 60 controls the main switching elements Q1 and Q2 and the auxiliary switching elements S1 to S4 of the inverter 30 through the driving unit 40 such that the high-frequency voltage is time-divisionally supplied to each heating coil L2, L3 or L4. At this time, the control unit 60 controls the timing of at least one of the main switching elements Q1 and Q2 and the auxiliary switching elements S1 to S4 to be varied in order to control the power levels of the heating coils L2, L3 and L4, on which the containers are positioned.

When the control unit 60 time-divisionally controls the heating coils L2, L3 and L4, on which the containers are positioned, the power levels of the time-divisionally controlled heating coils may be controlled using two methods.

In a first method, the time-divisional control times when the auxiliary switching elements corresponding to the time-divisionally controlled heating coils are switched on are fixed and the duty ratios of the pulse width modulation signals supplied to the main switching elements Q1 and Q2 are varied according to values corresponding to the power levels of the heating coils during the time-divisional control time.

In a second method, the duty ratios supplied to the main switching elements Q1 and Q2 are fixed to a value corresponding to a maximum power level (Pmax in FIG. 10) among the power levels of the heating coils L2, L3 and L4, on which the containers are positioned, and the on times of the auxiliary switching elements corresponding to the time-divisionally controlled heating coils are varied according to values corresponding to the power levels of the time-divisionally controlled heating coils in consideration of the maximum power level.

Figure 11:
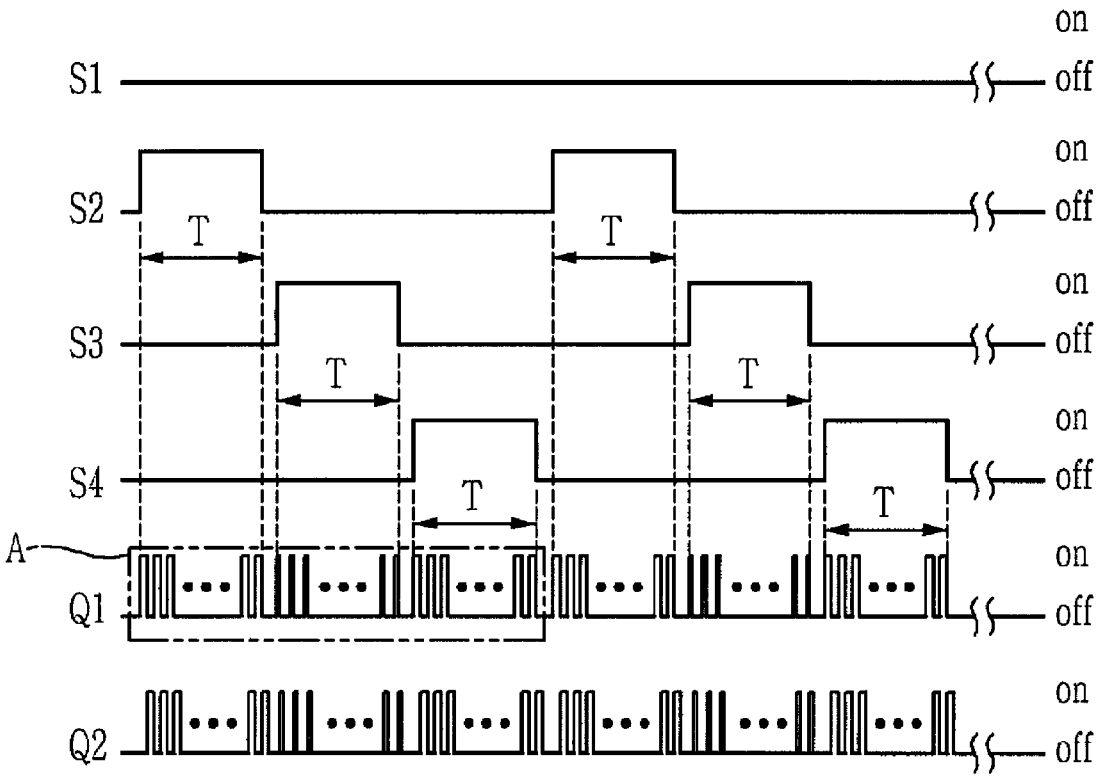
FIG. 11 is a timing chart of the switching elements shown in FIG. 8.
Figure 12:
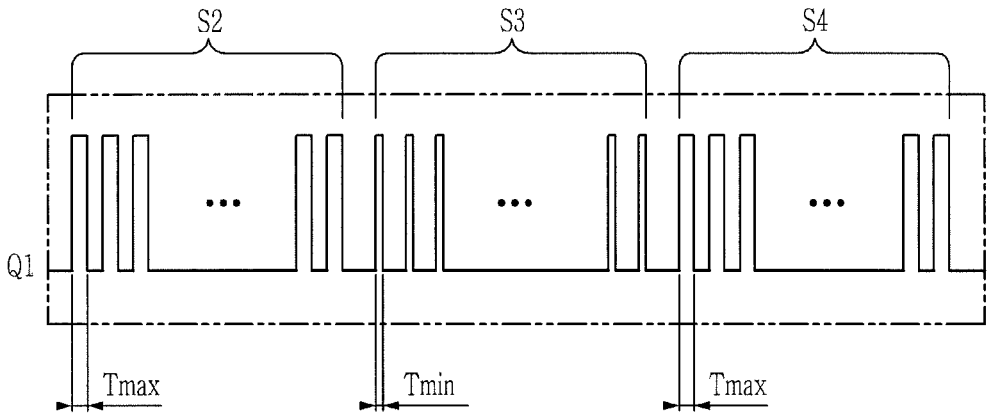
FIG. 12 is an enlarged diagram of a region A shown in FIG. 11.

FIG. 11 is a timing chart of the switching elements shown in FIG. 8 in order to illustrate the control of the power levels of the heating coils using the first method to control the power levels of the heating coils. FIG. 12 is an enlarged diagram of a region A shown in FIG. 11 in order to illustrate a variation in duty ratio of the first main switching element Q1.

As shown in FIG. 11, the control unit 60 selectively switches the auxiliary switching element S2, S3 or S4 connected to the heating coil L2, L3 or L4, on which the containers are positioned, on or off to time-divisionally control the auxiliary switching element S2, S3 or S4 to be sequentially switched on during a predetermined time T in order of the second auxiliary switching element S2, the third auxiliary switching element S3 and the fourth auxiliary switching element S4.

As shown in FIG. 11, at first only the second auxiliary switching element S2 is switched on during the predetermined time T and, if the predetermined time T elapses, the second auxiliary switching element S2 is switched off and the third auxiliary switching element S3 is switched on during the predetermined time T after a predetermined dead time elapses. In addition, if the predetermined time T elapses, the third auxiliary switching element S3 is switched off and the fourth auxiliary switching element S4 is switched on during the predetermined time T after the predetermined dead time elapses. This procedure is repeated to control the operations of the second auxiliary switching element S2 to the fourth auxiliary switching element S4. At this time, the dead time indicates a time to prevent two auxiliary switching elements from being simultaneously switched on.

The control unit 60 first switches only the second auxiliary switching element S2 connected to the second heating coil L2 on to open the current path such that current flows through only the second heating coil L2 and alternately switches the main switching elements Q1 and Q2 to supply the high-frequency voltage to the second heating coil L2 such that high-frequency current flows through the second heating coil L2. Then, an alternating magnetic field is generated in the second heating coil L2 by the high-frequency current flowing through the second heating coil L2 to generate eddy current in the container P24 positioned on the second heating coil L2 such that the container P24 is heated by Joule's heat generated by the eddy current. As the container P24 is heated, food in the container is cooked.

At this time, the control unit 60 switches only the second auxiliary switching element S2 on during the predetermined time T (for example, 0.1 sec to 3 sec) through the driving unit 40 such that the power level of the second heating coil L2 reaches the power level input through the input unit 80, sets the duty ratios of the pulse width modulation signals supplied to the main switching elements Q1 and Q2 to the value corresponding to the power level of the second heating coil L2 during the predetermined time T, and supplies the pulse width modulation signals having the set duty ratios to the main switching elements Q1 and Q2 during the on time of the second auxiliary switching element S2 to alternately switch the main switching elements Q1 and Q2. At this time, the pulse width modulation signals supplied to the first main switching element Q1 and the second main switching element Q2 have the same duty ratio and a constant delay time such that the main switching elements are alternately switched.

For example, since the power level of the second heating coil L2 is Pmax, the control unit 60 controls the duty ratios of the pulse width modulation signals supplied to the main switching elements Q1 and Q2 to the value corresponding to Pmax such that the power level of the second heating coil L2 becomes Pmax during the predetermined time T when the second auxiliary switching element S2 is continuously switched on.

In addition, if the time-divisional control of the second heating coil L2 is finished, the control unit 60 begins the time-divisional control of the third heating coil L3.

If the time-divisional control of the second heating coil L2 is finished, the control unit 60 switches the second auxiliary switching element S2 off, switches only the third auxiliary switching element S3 connected to the third heating coil L3 on, and alternately switches the main switching elements Q1 and Q2 to supply the high-frequency voltage to the third heating coil L3, such that high-frequency current flows through the third heating coil L3 to heat the container P3.

At this time, the control unit 60 switches only the third auxiliary switching element S3 on during the predetermined time T through the driving unit 40 such that the power level of the third heating coil L3 reaches the power level input through the input unit 80, sets the duty ratios of the pulse width modulation signals supplied to the main switching elements Q1 and Q2 to the value corresponding to the power level of the third heating coil L3 during the predetermined time T, and supplies the pulse width modulation signals having the set duty ratios to the main switching elements Q1 and Q2 during the on time of the third auxiliary switching element S3 to alternately switch the main switching elements Q1 and Q2. At this time, the pulse width modulation signals supplied to the first main switching element Q1 and the second main switching element Q2 have the same duty ratio and a constant delay time such that the main switching elements are alternately switched.

For example, since the power level of the third heating coil L3 is Pmin, the control unit 60 controls the duty ratios of the pulse width modulation signals supplied to the main switching elements Q1 and Q2 to the value corresponding to Pmin such that the power level of the third heating coil L3 becomes Pmin during the predetermined time T when the third auxiliary switching element S3 is continuously switched on. At this time, the duty ratio of the pulse width modulation signal corresponding to Pmin is lower than the duty ratio of the pulse width modulation signal corresponding to Pmax.

As shown in FIG. 12, it can be seen that the duty ratios of the pulse width modulation signals supplied to the main switching elements Q1 and Q2 in the period when the second auxiliary switching element is switched on are greater than the duty ratios of the pulse width modulation signals supplied to the main switching elements Q1 and Q2 in the period when the third auxiliary switching element is switched on. At this time, Tmax indicates the on time of the duty ratios of the pulse width modulation signal supplied to the main switching elements Q1 and Q2 in the period when the second auxiliary switching element is switched on, and Tmin indicates the on time of the duty ratios of the pulse width modulation signal supplied to the main switching elements Q1 and Q2 in the period when the third auxiliary switching element is switched on.

If the time-divisional control of the third heating coil L3 is finished, the control unit 60 begins the time-divisional control of the fourth heating coil L4. Since the power level of the fourth heating coil L4 is equal to the power level of the second heating coil L2, the time-divisional control of the fourth heating coil L4 is equal to the time-divisional control of the second heating coil L2.

Using this method, the time-divisional control of the heating coils L2, L3 and L4, on which the containers are positioned, is repeated.

Figure 13:
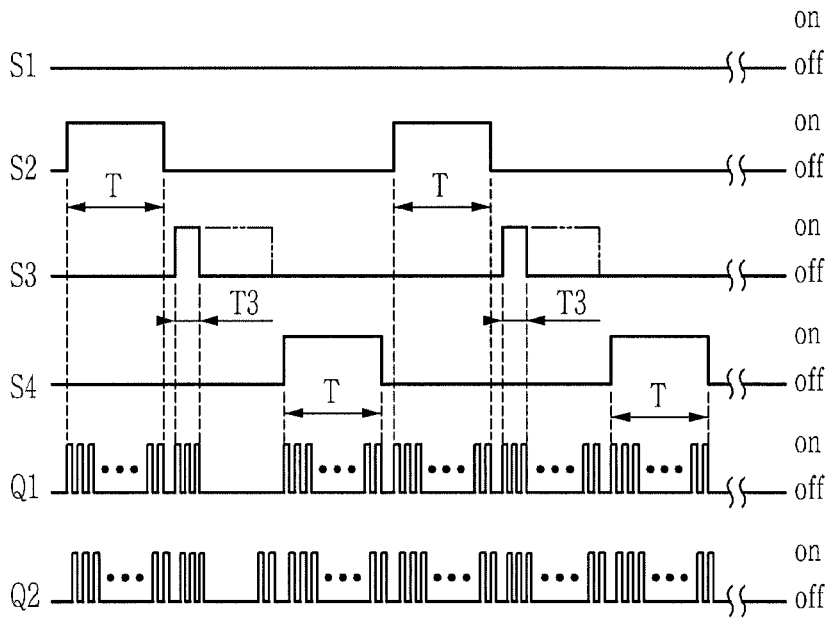
FIG. 13 is another timing diagram of the switching elements shown in FIG. 8.

FIG. 13 is a timing chart to control the power levels of the heating coils using the second method to control the power levels of the heating coils.

As shown in FIG. 13, the control unit 60 sets the duty ratios of the pulse width modulation signals supplied to the main switching elements Q1 and Q2 to the value corresponding to the maximum power level Pmax of the power levels of the heating coils L2, L3 and L4, on which the containers are positioned, and controls the duty ratios of the pulse width modulation signals supplied to the main switching elements Q1 and Q2 to the value corresponding to the maximum power level Pmax, in the period when each auxiliary switching element S1, S2 or S3 is switched on.

The control unit 60 varies the on time of the auxiliary switching element corresponding to the time-divisionally controlled heating coil in proportion to the value corresponding to the maximum power level.

For example, if the power levels of the heating coils L2, L3 and L4, on which the containers are positioned, are respectively 3200 W, 800 W and 3200 W, the duty ratios of the pulse width modulation signals supplied to the main switching elements Q1 and Q2 are set to the value corresponding to 3200 W.

When the pulse width modulation signals having the duty ratios corresponding to 3200 W are supplied to the main switching elements Q1 and Q2, the on time T of the second auxiliary switching element S2 to enable the power level of the second heating coil L2 to reach 3200 W is set, the second auxiliary switching element S2 is switched on during the set on time T. For reference, T3 indicates the on time of the third auxiliary switching element S3 and is less than the on time T of the second auxiliary switching element S2. This is because the power level of the third heating coil L3 is lower than the power level of the second heating coil L2.

Using this method, the power levels of the third heating coil L3 and the fourth heating coil L4 are controlled.

Although the duty ratios of the pulse width modulation signals supplied to the main switching elements Q1 and Q2 are set to the value corresponding to the maximum power level Pmax, the embodiments of the present invention are not limited thereto and the duty ratios of the pulse width modulation signals may be set to a highest power level that the induction heating cooker is capable of outputting.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An induction heating cooker, comprising:

a plurality of heating coils;

an inverter having a plurality of auxiliary switching elements connected to the plurality of heating coils and operable to selectively supply a high-frequency voltage to the plurality of heating coils, and main switching elements switchable to supply the high-frequency voltage to at least one heating coil of the plurality of heating coils; and a control unit configured to control operations of at least one of the plurality of auxiliary switching elements such that the high-frequency voltage is time-divisionally supplied for time-divisional control to at least one heating coil of the plurality of heating coils on which a container is to be positioned, and to control power levels of the time-divisionally controlled at least one heating coil of the plurality of heating coils.

2. The induction heating cooker according to claim 1, further comprising a sensing unit to sense a current flowing through the plurality of heating coils, wherein the control unit is further configured to determine the at least one heating coil on which the container is to be positioned by, sequentially switching on the at least one of the plurality of auxiliary switching elements such that current sequentially flows through the at least one heating coil of plurality of heating coils, and determine that the container is positioned on the at least one heating coil, when a current value is sensed to exceed a predetermined value.

3. The induction heating cooker according to claim 2, further comprising a display unit to display positional information of the at least one heating coil, on which the container is determined to be positioned.

4. The induction heating cooker according to claim 2, further comprising an input unit to receive the power levels of the at least one heating coil, on which the container is determined to be positioned.

5. The induction heating cooker according to claim 4, wherein the control unit is further configured to control the power levels of the at least one heating coil, on which the container is determined to be positioned, by varying duty ratios of pulse width signals being supplied to the main switching elements, respectively, during a period when the at least one of the plurality of auxiliary switching elements is continuously switched on.

6. The induction heating cooker according to claim 5, wherein the control unit is further configured to supply pulse width modulation signals, having duty ratios set to values corresponding to power levels of the time-divisionally controlled at least one heating coil of the plurality of heating coils, to the main switching elements.

7. The induction heating cooker according to claim 1, wherein:

when the container is positioned on a plurality of heating coils, the control unit is further configured to supply pulse width modulation signals, each having a same duty ratio to the main switching elements, and vary on-times of the at least one of the plurality of auxiliary switching elements corresponding to the time-divisionally controlled at least one heating coil to control the power levels of the time-divisionally controlled at least one heating coil.

8. The induction heating cooker according to claim 7, wherein the duty ratios of the pulse width modulation signals supplied to the main switching elements are set to a value corresponding to a maximum power level among the power levels of the at least one heating coil, on which the container is to be positioned.

9. The induction heating cooker according to claim 8, wherein the control unit varies the on-times of the at least one of the auxiliary switching elements corresponding to the time-divisionally controlled heating coils according to the maximum power level.

10. The induction heating cooker according to claim 7, wherein the same duty ratio of the pulse width modulation signals supplied to the main switching elements are set to a value corresponding to a highest power level that the induction heating cooker is capable of outputting.

11. The induction heating cooker according to claim 10, wherein the control unit is further configured to vary the on-times of the at least one of the plurality of auxiliary switching elements corresponding to the time-divisionally controlled at least one heating coil according to the highest power level.

12. An induction heating cooker comprising:

a plurality of heating coils to heat a container;

an inverter having a plurality of auxiliary switching elements operable to selectively supply a high-frequency voltage to the plurality of heating coils, and a main switching elements switchable to supply the high-frequency voltage to at least one heating coil of the plurality of heating coils; and a control unit configured to control operations of at least one of the plurality of auxiliary switching elements such that the high-frequency voltage is time-divisionally supplied for time-divisional control to at least one heating coil of the plurality of heating coils on which the container is to be positioned, to control on-times of at least one of the plurality of auxiliary switching elements corresponding to the time-divisionally controlled at least one heating coils to be the same.

13. An induction heating cooker comprising:

a plurality of heating coils to heat a container;

an inverter having a plurality of auxiliary switching elements operable to selectively supply a high-frequency voltage to the plurality of heating coils, and a main switching elements switchable to supply the high-frequency voltage to one of the plurality of heating coils; and a control unit to supply pulse width modulation signals having a same duty ratio to the main switching elements and to control operations of at least one of the plurality of auxiliary switching elements such that the high-frequency voltage is time-divisionally supplied for time-divisional control to at least one heating coil of the plurality of heating coils on which the container is to be positioned, among the plurality of heating coils, wherein the control unit is to further vary on-times of at least one of the auxiliary switching elements corresponding to the time divisionally controlled at least one heating coil to control power levels of the time-divisionally controlled at least one heating coil.

14. The induction heating cooker according to claim 13, wherein the same duty ratio of the pulse width modulation signals supplied to the main switching elements are set to a value corresponding to a maximum power level among the power levels of the at least one heating coil of the plurality of heating coils on which the container is to be positioned, or a highest power level that the induction heating cooker is capable of outputting.

15. The induction heating cooker according to claim 12, wherein the control unit is further configured to switch the at least one of the plurality of auxiliary switching elements corresponding to the at least one heating coil on which the container is positioned, on the same time and vary duty ratios of pulse width modulation signals supplied to the main switching elements in a period when the at least one of the plurality of auxiliary switching elements is continuously switched on to control the power levels of the time-divisionally controlled at least one heating coil.

* * * * *